US010526051B2

(12) United States Patent
Kristiansen

(10) Patent No.: US 10,526,051 B2
(45) Date of Patent: Jan. 7, 2020

(54) EVACUATION SYSTEM

(71) Applicant: VIKING LIFE-SAVING EQUIPMENT A/S, Esbjerg (DK)

(72) Inventor: Søren Kristiansen, Esbjerg (DK)

(73) Assignee: VIKING LIFE-SAVING EQUIPMENT A/S, Esbjerg (FI)

( * ) Notice: Subject to any disclaimer, the term of this patent is extended or adjusted under 35 U.S.C. 154(b) by 0 days.

(21) Appl. No.: 15/736,157

(22) PCT Filed: Jun. 29, 2016

(86) PCT No.: PCT/EP2016/065079
§ 371 (c)(1),
(2) Date: Dec. 13, 2017

(87) PCT Pub. No.: WO2017/001443
PCT Pub. Date: Jan. 5, 2017

(65) Prior Publication Data

US 2018/0141620 A1 May 24, 2018

(30) Foreign Application Priority Data

Jun. 30, 2015 (EP) ..... 15174690

(51) Int. Cl.
*B63B 23/44* (2006.01)
*B63B 23/48* (2006.01)
(Continued)

(52) U.S. Cl.
CPC ..... *B63B 23/44* (2013.01); *B63B 7/085* (2013.01); *B63B 9/04* (2013.01); *B63B 23/48* (2013.01);
(Continued)

(58) Field of Classification Search
CPC ..... B63B 23/44; B63B 9/04; B63B 27/10; B63B 7/085; B63B 23/58; B63B 23/48; B63C 9/22; B63C 2009/042
See application file for complete search history.

(56) References Cited

U.S. PATENT DOCUMENTS 2,091,327 A 8/1937 McPartland
5,706,755 A 1/1998 O'Brien
(Continued)

FOREIGN PATENT DOCUMENTS

FR 2 092 713 1/1972
WO WO 2007/129335 11/2007
WO WO 2012/172081 12/2012

OTHER PUBLICATIONS

International Search Report and Written Opinion of the ISA for PCT/EP2016/065079, dated Oct. 4, 2016, 12 pages.
(Continued)

*Primary Examiner* — Anthony D Wiest
(74) *Attorney, Agent, or Firm* — Nixon & Vanderhye P.C.

(57) ABSTRACT

The present invention relates to an evacuation system for positioning and maintaining a position of an inflatable floatable unit in relation to a maritime structure during evacuation of persons at sea, comprising a maritime structure from which persons are to be evacuated, an inflatable floatable unit configured to be deployed from the maritime structure, and a bowsing system comprising a first bowsing line extending from the maritime structure to the inflatable floatable unit, and a first bowsing winch configured to, by means of the first bowsing line, bowse and position the inflatable floatable unit in relation to the maritime structure after it has been deployed from the maritime structure into the water, wherein the bowsing system further comprises a first hydraulic cylinder having a piston with a first piston end extending outside the first hydraulic cylinder, and a first
(Continued)

hydraulic accumulator which is in fluid communication with the first hydraulic cylinder, the first piston end being connected with the first bowsing line between the first bowsing winch and the inflatable floatable unit. Furthermore, the present invention relates to a bowsing method for positioning and maintaining a position of an inflatable floatable unit in relation to a maritime structure during evacuation of persons at sea.

15 Claims, 7 Drawing Sheets

(51) Int. Cl.

| | |
|---|---|
| ***B63C 9/22*** | (2006.01) |
| ***B63B 7/08*** | (2006.01) |
| ***B63B 23/58*** | (2006.01) |
| ***B63B 9/04*** | (2006.01) |
| ***B63B 27/10*** | (2006.01) |
| *B63C 9/04* | (2006.01) |

(52) U.S. Cl.
CPC ..... *B63B 23/58* (2013.01); *B63B 27/10* (2013.01); *B63C 9/22* (2013.01); *B63C 2009/042* (2013.01)

(56) References Cited

U.S. PATENT DOCUMENTS 7,159,527 B2 * 1/2007 Nielsen ..... B63B 21/00 114/230.2
8,316,991 B2 * 11/2012 Akselsen ..... A62B 1/20 114/365

OTHER PUBLICATIONS

Extended Search Report for EP 15174690.6, dated Dec. 18, 2015, 8 pages.

* cited by examiner

EVACUATION SYSTEM

This application is U.S. national phase of International Application No. PCT/EP2016/065079 filed Jun. 29, 2016, which designated the U.S. and claims priority to EP Patent Application No. 15174690.6 filed Jun. 30, 2015, the entire contents of each of which are hereby incorporated by reference.

FIELD OF THE INVENTION

The present invention relates to an evacuation system for positioning and maintaining a position of an inflatable floatable unit in relation to a maritime structure during evacuation of persons at sea, comprising a maritime structure from which persons are to be evacuated, an inflatable floatable unit configured to be deployed from the maritime structure, and a bowsing system. The bowsing system comprises a first bowsing line extending from the maritime structure to the inflatable floatable unit, and a first bowsing winch configured to, by means of the first bowsing line, bowse and position the inflatable floatable unit in relation to the maritime structure after it has been deployed from the maritime structure into the water. Furthermore, the present invention relates to a bowsing method for positioning and maintaining a position of an inflatable floatable unit in relation to a maritime structure during evacuation of persons at sea.

BACKGROUND ART

Bowsing a floatable unit such as a liferaft to a vessel or to an offshore installation is a difficult task. There are many different circumstances which make it difficult to position a floatable unit and maintain its position.

These circumstances may inter alia be Stokes drift, wave heights, wind load, rolling of the vessel and drift of the vessel.

In addition, the capacity of the evacuation systems in relation to persons to be evacuated tends to increase. Thus, the number of liferafts, as well as their size, increases. Accordingly, higher impact and forces may be exerted on the bowsing systems.

Since the forces and loads exerted on the bowsing today are considerable and will be even higher in the future, especially in high seas and under heavy weather conditions, it is difficult to control the bowsing of the known systems. Also, if the vessel and the liferafts are moving at different speeds, the bowsing system shall be configured to control the liferafts independently and together. However, during this control of the liferafts, a certain "braking distance" is necessary, otherwise the inertia of the system will peak the forces, which may damage the bowsing line and/or the liferaft.

SUMMARY OF THE INVENTION

It is an object of the present invention to wholly or partly overcome the above disadvantages and drawbacks of the prior art. More specifically, it is an object to provide an improved evacuation system having a bowsing system which is configured to absorb larger forces and loads.

The above objects, together with numerous other objects, advantages and features, which will become evident from the below description, are accomplished by a solution in accordance with the present invention by an evacuation system for positioning and maintaining a position of an inflatable floatable unit in relation to a maritime structure during evacuation of persons at sea, comprising:

- a maritime structure from which persons are to be evacuated,
- an inflatable floatable unit configured to be deployed from the maritime structure, and
- a bowsing system comprising:
  - a first bowsing line extending from the maritime structure to the inflatable floatable unit, and
  - a first bowsing winch configured to, by means of the first bowsing line, bowse and position the inflatable floatable unit in relation to the maritime structure after it has been deployed from the maritime structure into the water, wherein the bowsing system further comprises a first hydraulic cylinder having a piston with a first piston end extending outside the first hydraulic cylinder, and a first hydraulic accumulator which is in fluid communication with the first hydraulic cylinder, the first piston end being connected with the first bowsing line between the first bowsing winch and the inflatable floatable unit.

Furthermore, the maritime structure may comprise one or more side turning points arranged on a side of the maritime structure at sea level, the bowsing line being configured to extend from the maritime structure via the side turning point to the inflatable floatable unit.

A first flexible member may be connected with the first bowsing line, the first flexible member being arranged between the first bowsing line and the inflatable floatable unit.

Moreover, the first flexible member may be a spring, an elastic element, or a plurality of elastic bands interconnected to form the flexible member.

Also, the piston may have a second piston end within the first hydraulic cylinder having a longitudinal extension, the piston being movable in the longitudinal extension of the hydraulic cylinder.

Furthermore, the hydraulic cylinder may have a cylinder chamber.

In addition, the first hydraulic accumulator may have a first part comprising a gas and a second part comprising a fluid, the second part being fluidly connected with the hydraulic cylinder, and the first part and the second part being separated from each other by a piston or a diaphragm, the hydraulic accumulator having a volume and the hydraulic accumulator being set with a gas pre-charge pressure.

Also, a first valve may be arranged between the hydraulic cylinder and the hydraulic accumulator.

Said valve may be a throttle valve or a ball valve.

Moreover, the valve may be opened by a predetermined position of the first piston end.

Further, the maritime structure may be a vessel or an offshore installation.

The vessel may be a ship, a cargo ship, a passenger carrier, a cruise ship or a ferry.

Also, the offshore installation may be a drilling rig, an oil rig or platform, or an oil production rig or platform.

Furthermore, the evacuation system may comprise a deployment structure connected to the maritime structure.

Additionally, the deployment structure may be configured to house and store the deflated floatable unit.

Moreover, the deployment structure may have a deployment side facing away from the maritime structure.

Further, the bowsing winch, the hydraulic cylinder and the hydraulic accumulator may be connected with the deployment structure.

Also, the bowsing system may comprise a gearing system, the bowsing line being configured to be led through the gearing system which is arranged between the deployment structure and the first piston end of the hydraulic cylinder.

The gearing system may comprise a plurality of structure turning points connected with the deployment structure and at least a piston turning point connected with the first piston end.

Furthermore, the bowsing line may be led back and forth between the turning points.

Moreover, the number of structure turning points may be higher than the number of piston turning points.

In addition, the bowsing line may extend from a structure turning point to a piston turning point to another structure turning point and so on.

Also, blocks may be arranged in connection with the turning points in order to facilitate smooth movement of the bowsing line around the turning points and to prevent kinking of the bowsing line.

Further, the deployment structure may comprise horizontal beams and vertical beams.

Additionally, the hydraulic cylinder may be arranged vertically or horizontally.

The structure turning points may primarily be arranged on the horizontal beam arranged above the cylinder when the hydraulic cylinder is arranged vertically, or the structure turning points may primarily be arranged on the vertical beam when the hydraulic cylinder is arranged horizontally.

Moreover, the bowsing winch may be driven by a motor.

Furthermore, the deployment structure may be arranged on a deck of the maritime structure.

In addition, the maritime structure may have a side and one or more side turning points being arranged on the side at a predetermined distance below the deployment structure or at a predetermined distance above sea level.

Also, the bowsing lines may extend from the deployment structure to the inflatable floatable unit via the side turning points.

The evacuation system may comprise a plurality of inflatable floatable units.

The inflatable floatable unit may be an inflatable liferaft predominately made of a non-rigid material.

Moreover, the evacuation system may comprise a chute extending from the deployment structure to the inflatable floatable unit for evacuation of persons from the maritime structure to the inflatable floatable unit.

The bowsing system of the evacuation system as described above may comprise:

- a second bowsing line extending from the maritime structure to the inflatable floatable unit,
- a second bowsing winch configured to bowse and position the inflatable floatable unit in relation to the maritime structure after it has been deployed from the maritime structure into the water,
- a second hydraulic cylinder having a piston with a first piston end extending outside the second hydraulic cylinder, and
- a second hydraulic accumulator being in fluid communication with the second hydraulic cylinder, the first piston end being connected with the second bowsing line between the second bowsing winch and the inflatable floatable unit.

The present invention also relates to a bowsing method for positioning and maintaining a position of an inflatable floatable unit in relation to a maritime structure during evacuation of persons at sea, comprising:

- providing an evacuation system according to any of the preceding claims,
- deploying an inflatable floatable unit from the maritime structure,
- bowsing the inflatable floatable unit by means of the bowsing winch and bowsing line in relation to the maritime structure, and
- absorbing forces exerted on the inflatable floatable unit by means of the hydraulic cylinder.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
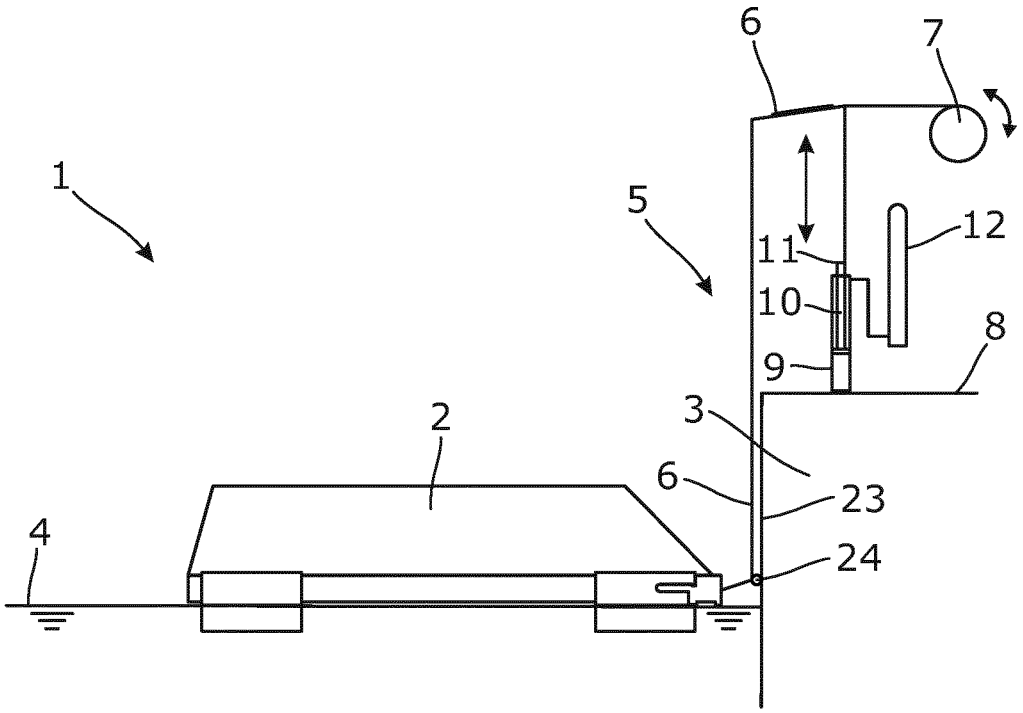
FIG. 1 shows the evacuation system according to the invention.

FIG. 1 shows an evacuation system 1 for positioning and maintaining a position of an inflatable floatable unit 2 in relation to a maritime structure 3 during evacuation of persons at sea.

The maritime structure 3 may be a vessel or an offshore installation. In the following, the maritime structure will mainly be described in relation to a vessel. The vessel may preferably be a passenger ship, such as a ferry or a cruise ship carrying a large number of passengers and crew members.

The evacuation system 1 comprises a maritime structure 3, in FIG. 1 shown as a vessel, from which persons are to be evacuated, an inflatable floatable unit configured to be deployed from the maritime structure 3 into the water 4, and a bowsing system 5 comprising a first bowsing line 6 extending from the maritime structure 3 to the inflatable floatable unit 2. The bowsing system 5 also comprises a first bowsing winch 7 configured to, by means of the first bowsing line 6, bowse and position the inflatable floatable unit 2 in relation to the maritime structure 3 after it has been deployed from the maritime structure 3 into the water 4.

The inflatable floatable unit 2 is stored in a deflated condition on the vessel 3 and after it has been deployed from the vessel 3, it is inflated in the water 4. The crew members handling the evacuation system 1 onboard the vessel will then use the bowsing winch 7 to initially bowse the inflatable floatable unit 2 in relation to the vessel, so that it is positioned correctly in view of the height from the water 4 to a deck 8 of the vessel 3.

The bowsing system 5 further comprises a first hydraulic cylinder 9 having a piston 10 with a first piston end 11 extending outside the first hydraulic cylinder 9, and a first hydraulic accumulator 12 which is in fluid communication with the first hydraulic cylinder 9. The first piston end 11 is connected with the first bowsing line 6 between the first bowsing winch 7 and the inflatable floatable unit 2.

Hereby it is obtained that the hydraulic cylinder together with the hydraulic accumulator absorb peak tensions in the bowsing line 6 caused inter alia by the movement of the inflatable floatable unit in the waves in relation to movement of the vessel and/or rolling of the vessel, so that it is avoided that the bowsing line and/or the inflatable floatable unit is/are damaged. An evacuation system 1 is thereby provided wherein the risk for failure of the bowsing system due to high peak forces caused by different movements of the inflatable floatable units and the vessel, respectively, is minimised considerably.

The maritime structure 3 may comprise one or more side turning points 24 arranged on a side 23 of the maritime structure 3 at sea level 4. The bowsing line 6 is configured to extend from the maritime structure via the side turning point 24 to the inflatable floatable unit 2. Hereby it is obtained that the bowsing line may absorb movements of the inflatable floatable unit 2 in substantially horizontal directions, i.e. along and/or transverse to the maritime structure. The bowsing line may also compensate for movements of the inflatable floatable unit caused by waves and wind. Thereby the inflatable floatable unit is maintained in position in relation to the maritime structure during the evacuation.

Figure 2:
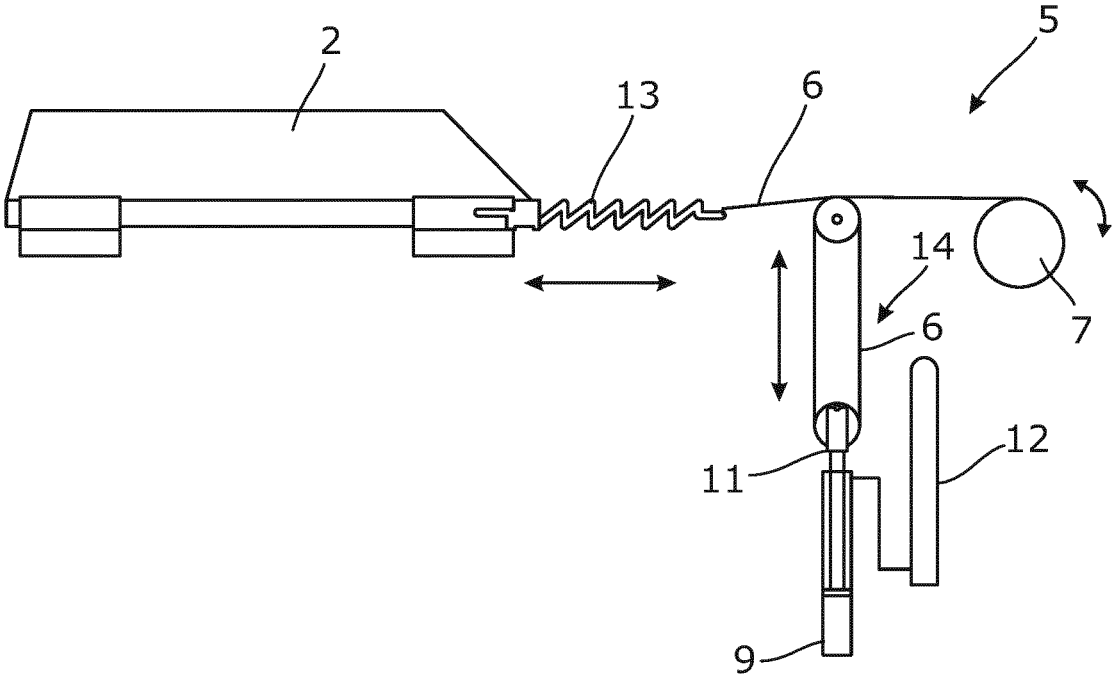
FIG. 2 shows another embodiment of the evacuation system according to the invention.

In FIG. 2, the evacuation system 1 of FIG. 1 is shown without the maritime structure, and the inflatable floatable unit 2 is aligned with the bowsing system 5 for further description. In addition to the features mentioned in relation to FIG. 1, the bowsing system 5 in FIG. 2 further comprises a first flexible member 13 which is connected with the first bowsing line 6. The first flexible member 13 is arranged between the first bowsing line 6 and the inflatable floatable unit 2. The flexible member is configured to absorb the more constant small forces in the bowsing line 6 caused by the wind load, the drift of the vessel and Stokes drift. In addition, the flexible member 13 may also ensure that the crew members do not severely pre-tension the bowsing line 6 by means of the bowsing winch 7.

The flexible member 13 may be a spring, an elastic element, or a plurality of elastic bands interconnected to form the flexible member.

In addition, the bowsing system comprises a gearing system 14, and the bowsing line 6 is configured to be led through the gearing system 14 which is arranged between a deployment structure (not shown in FIG. 2) and the first piston end 11 of the hydraulic cylinder 9. The gearing system 14 will be further described below.

Figure 3:
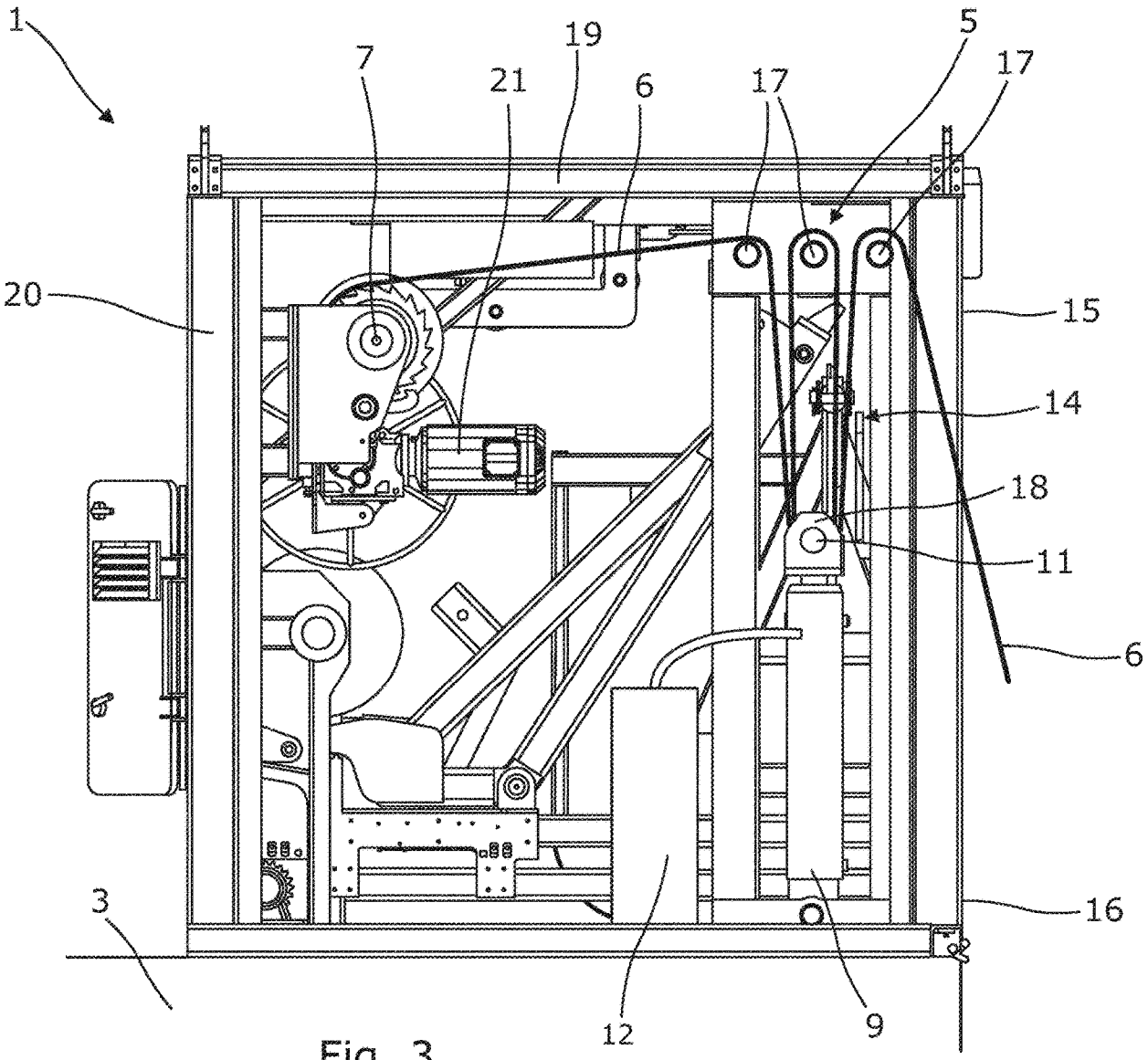
FIG. 3 shows a deployment structure having a vertically extending hydraulic cylinder.

FIG. 3 shows part of the evacuation system 1 comprising a deployment structure 15 connected to the maritime structure 3. The deployment structure 15 may be configured to house and store the deflated floatable unit (not shown) when it is not in use.

The deployment structure 15 has a deployment side 16 facing away from the maritime structure 3. In addition, the bowsing winch 7, the hydraulic cylinder 9 and the hydraulic accumulator 12 are connected with the deployment structure 15. As mentioned above, the bowsing system 5 comprises the gearing system 14, and the bowsing line 6 is configured to be led through the gearing system 14 which is arranged between the deployment structure 15 and the first piston end 11 of the hydraulic cylinder 9. The gearing system 14 comprises a plurality of structure turning points 17 connected with the deployment structure 15 and at least one piston turning point 18 connected with the first piston end 11. The bowsing line 6 is then led back and forth between the turning points 17, 18 as shown in FIG. 3. In FIG. 3, the bowsing line 6 extends from a structure turning point 17 to a piston turning point 18 to another structure turning point 17 and then back to another piston turning point 18 and on to yet another structure turning point and subsequently to the bowsing winch 7. Preferably, the number of structure turning points 17 is higher than the number of piston turning points 18.

Also, blocks (not shown) may be arranged in connection with the turning points 17, 18 in order to facilitate smooth movement of the bowsing line 6 around the turning points 17, 18 and to prevent kinking of the bowsing line 6.

The deployment structure 15 comprises horizontal beams 19 and vertical beams 20. In FIG. 3, the hydraulic cylinder 9 is arranged in a vertical position, wherein the first piston end 11 is configured to be moved up and down. When the hydraulic cylinder is arranged vertically, as shown in FIG. 3, the structure turning points 17 may primarily be arranged on or be connected to the horizontal beam 19 arranged above the hydraulic cylinder 9. In FIG. 3, the first piston end 11 is pulled upwards when it is absorbing the peak forces exerted on the bowsing line 6.

Furthermore, the bowsing winch 7 may be a hydraulic winch and may be driven by a motor 21.

Figure 4:
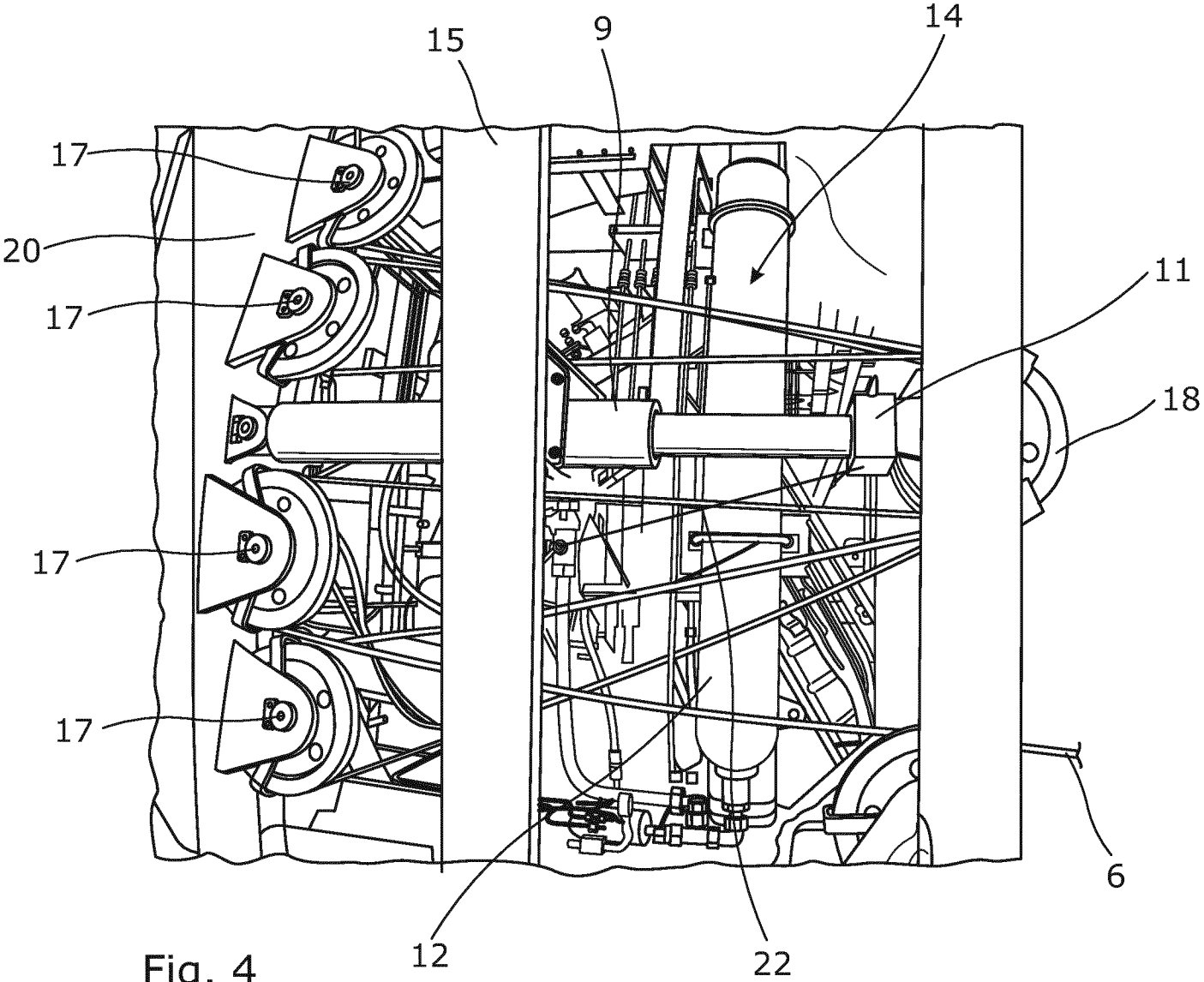
FIG. 4 shows a deployment structure having a horizontally extending hydraulic cylinder.

In FIG. 4, the hydraulic cylinder 9 is arranged horizontally When the hydraulic cylinder 9 is arranged horizontally, as shown in FIG. 4, the structure turning points 17 are primarily arranged on the vertical beam 20 of the deployment structure 15 horizontally. As shown in FIG. 4, the first piston end 11 of the hydraulic cylinder 9 is movable back and forth in a horizontal direction. The embodiment shown in FIG. 4 is expedient when the hydraulic cylinder 9 shall be configured to absorb large forces in the bowsing line 6. Furthermore, additional room for movement of the first piston end 11 is obtained since the piston end is able to project out of the deployment structure as shown in FIG. 4. The first piston end 11 also has a piston turning point 18, so that the bowsing line 6 may be led back and forth between the structure turning points 17 and the piston turning point 18 in the gearing system 14. During operation of the embodiment shown in FIG. 4, the first piston end 11 moves out in its extended position as shown in FIG. 4, so that it is pressed into the hydraulic cylinder 9 when it is absorbing the peak forces exerted on the bowsing line 6.

Furthermore, a first valve (not shown in FIG. 4) is arranged between the hydraulic cylinder 9 and the hydraulic accumulator 12. The valve may be a throttle valve or a ball valve. In the embodiment shown in FIG. 4, the valve may be opened by a predetermined position of the first piston end 11. In FIG. 4, a wire 22 is provided between the first piston end 11 and the valve, in which the wire 22 will be stretched during the outward movement of the first piston end 11. When the wire is stretched, it will, at a certain point, activate the valve so that it creates fluid communication between the hydraulic cylinder 9 and the hydraulic accumulator 12.

Figure 5:
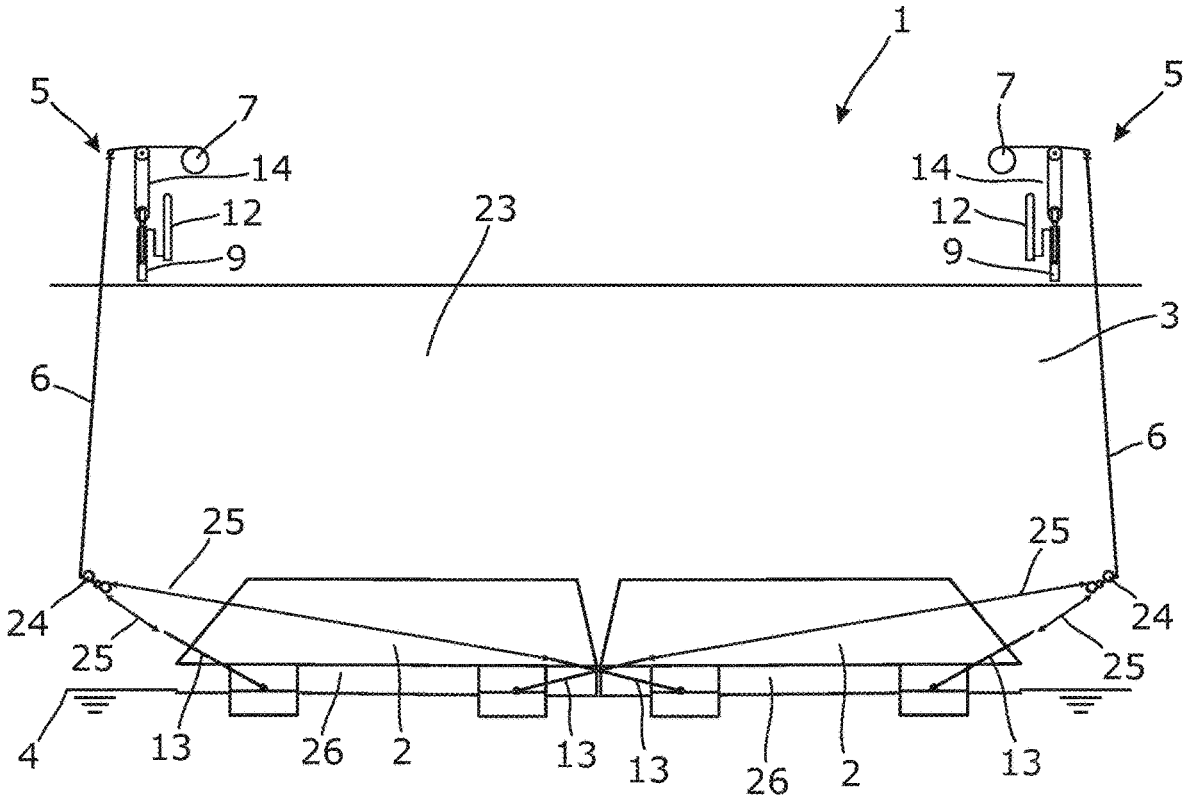
FIG. 5 shows the evacuation system with two inflatable floatable units bowsed and positioned to the maritime structure.

In FIG. 5, the evacuation system 1 has a plurality of inflatable floatable units 2, which in FIG. 5 is shown as two bowsed and positioned inflatable floatable units 2.

In addition, the bowsing system 5 comprises two bowsing lines 6, two bowsing winches 7, two hydraulic cylinders 9, two hydraulic accumulators 12 and two gearing systems 14. Hereby it is obtained that the inflatable floatable units 2 are positioned securely in relation to the vessel 3 during evacuation. The vessel 3 has a side 23 and one or more side turning points 24 arranged on the side 23 at a predetermined distance below the deployment structure (not shown). The bowsing lines 6 may extend from the deployment structure (not shown) to the inflatable floatable units 2 via the side turning points 24, in which it is ensured that the inflatable floatable units 2 are only movable along the vessel side 23 between the side turning points 24.

The bowsing lines 6 are, in this embodiment, divided into two sub-lines 25 which are connected to the flexible members 13. The flexible members 13 are connected with the sides 26 of the inflatable floatable units 2 facing away from the vessel side 23. Hereby the bowsing system 5 is configured to maintain the inflatable floatable units 2 in position in the transverse direction in relation to the vessel side 23.

Figure 6:
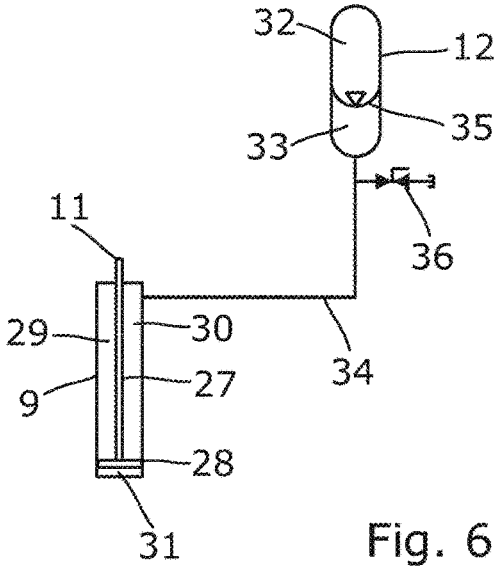
FIG. 6 shows an embodiment of the hydraulic cylinder and the hydraulic accumulator.

FIG. 6 shows the hydraulic cylinder 9 and the hydraulic accumulator 12. The embodiment shown in FIG. 6 may be used in connection with the bowsing system 5 described in connection with FIG. 3. The piston 27, which is movable in the longitudinal extension of the hydraulic cylinder 9, has a second piston end 28 within the hydraulic cylinder having a longitudinal extension. Furthermore, the hydraulic cylinder 9 has a cylinder chamber 29 which is divided into a first chamber part 30 and a second chamber part 31 by the second piston end 28.

In addition, the hydraulic accumulator 12 has a first part 32 comprising a gas and a second part 33 comprising a fluid. The second part 33 is fluidly connected with the first chamber part 30 of the hydraulic cylinder 9 via a conduit 34. The first part 32 and the second part 33 are separated from each other by a piston or a diaphragm 35, the hydraulic accumulator 12 having a volume and the hydraulic accumulator being set with a gas pre-charge pressure. A valve 36 is arranged between the accumulator 12 and the hydraulic cylinder 9.

Figure 7:
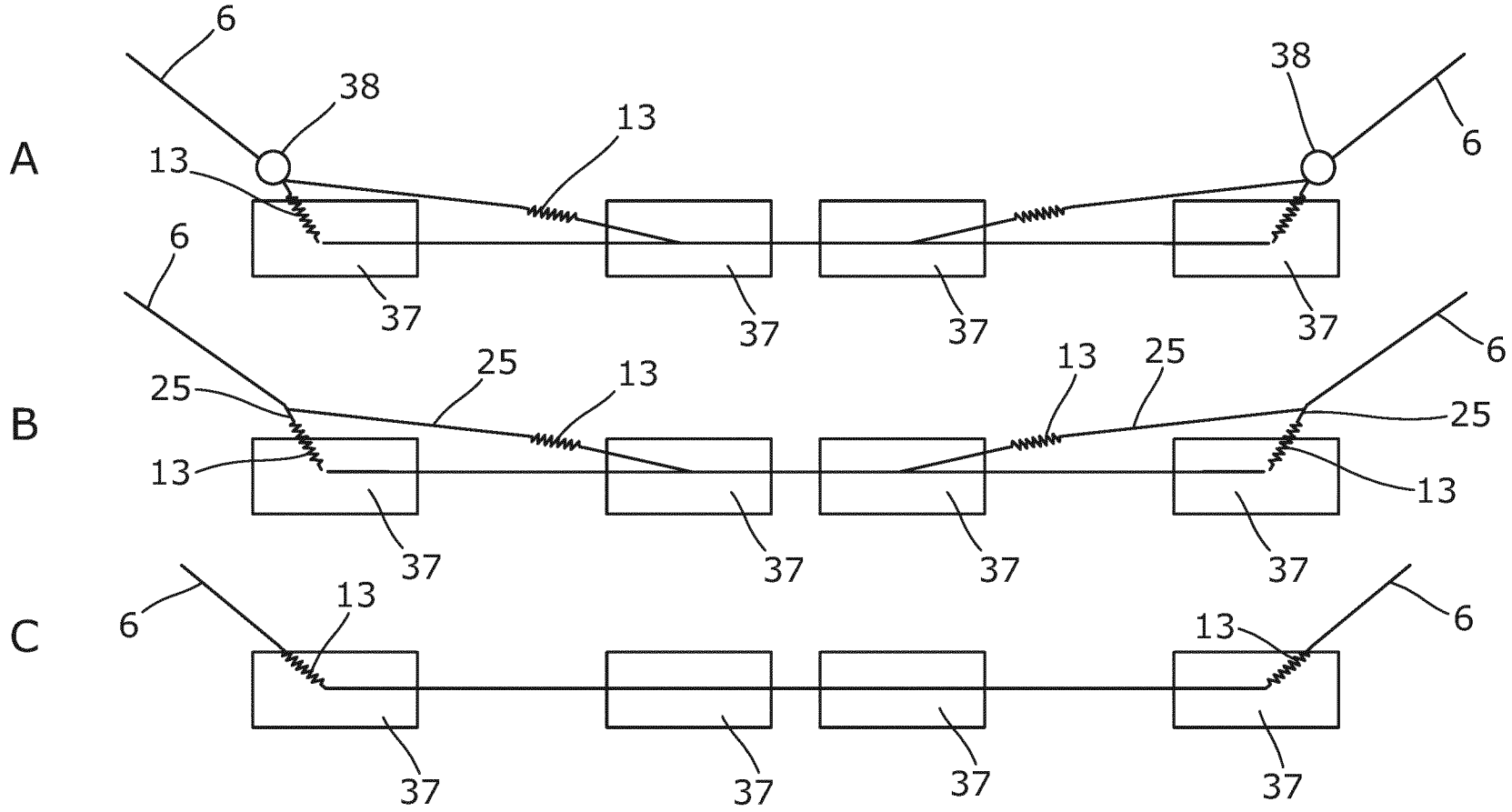
FIG. 7 shows different embodiments of connecting the bowsing line to the inflatable floatable unit.

FIG. 7 shows different ways to connect the bowsing lines 6 to the inflatable floatable unit. In these embodiments, the inflatable floatable units 2 comprise shells 37 which are all connected to the inflatable floatable units (not shown).

In A, the bowsing lines 6 extend from side turning points (not shown) towards the shells 37. The forces on the shells are distributed with a pulley 38 to two flexible members 13.

In B, the bowsing lines 6 extend from side turning points (not shown) towards the shells 37. The bowsing lines 6 are connected to two sub-lines 25, each having the flexible members 13.

In C, the flexible members 13 are connected to the first shells 37 which again are connected with the bowsing lines 6.

Furthermore, an additional line is provided between each shell, so that if only one inflatable floatable unit is left the bowsing system may still bowse this unit.

Figure 8:
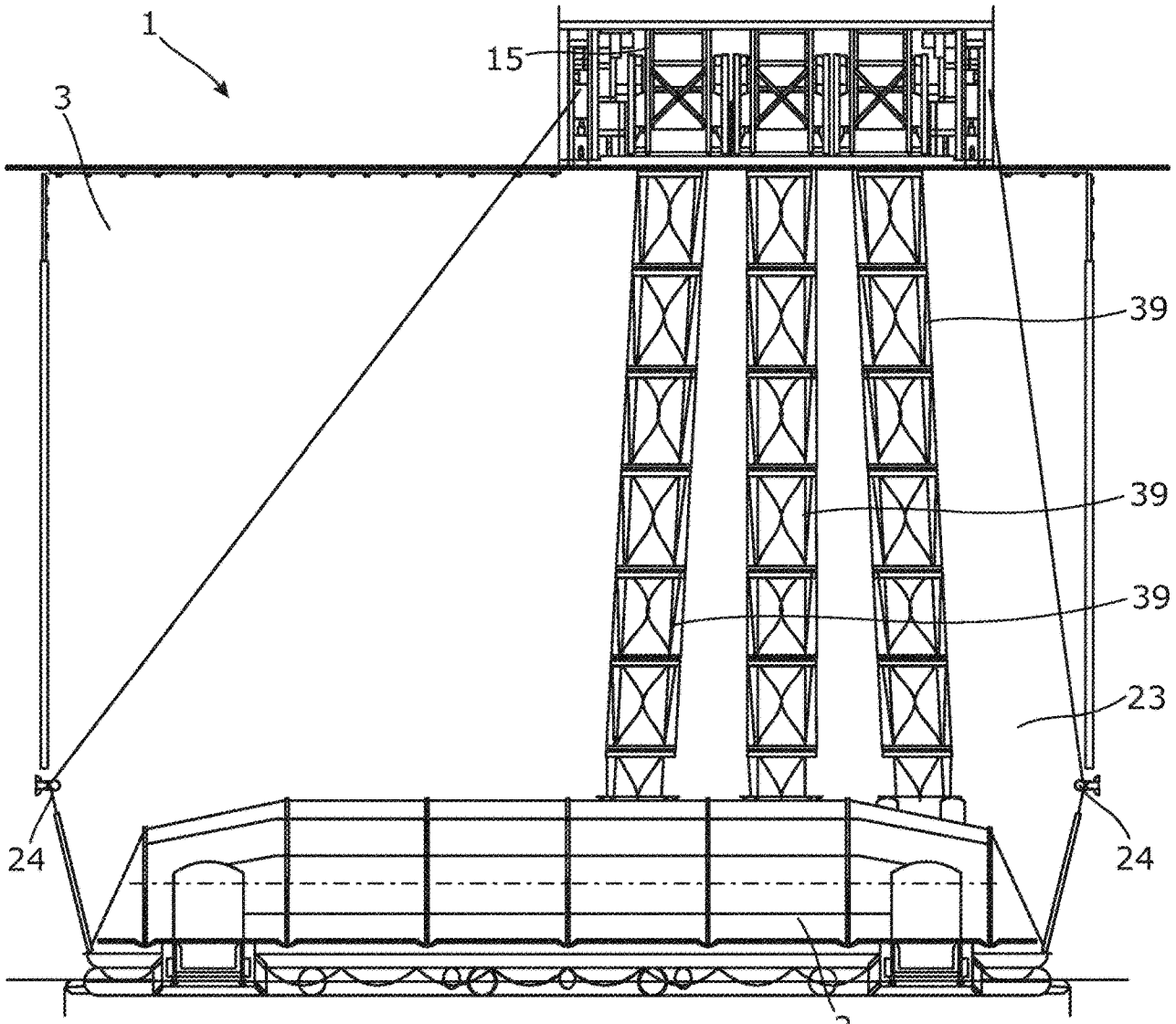
FIG. 8 shows an embodiment of the evacuation system with evacuation chutes.

In FIG. 8, an evacuation system 1 according to the invention is shown. Three evacuation chutes 39 extend from the deployment structure 15 to the inflatable floatable unit 2 for evacuation of persons from the vessel 3 to the inflatable floatable unit 2.

The deployment structure 15 is also adapted to house a deployment arrangement having a displacement device. The deployment structure 15 may be substantially box-shaped, having a rectangular configuration, as shown in FIG. 8, which facilitates interfacing and positioning of the deployment structure 15 on a vessel or an offshore installation.

Furthermore, the deployment arrangement (not shown) may have a displacement device, and the displacement device is adapted to displace the one or more inflatable floatable units in a substantially horizontal and linear direction out of the deployment structure 15 and subsequently lower the one or more inflatable floatable units into the water in a substantially vertical direction.

During storage, the inflatable floatable units may be positioned on a lifting platform inside the deployment structure, the lifting platform being adapted to carry the inflatable floatable units during deployment.

The deployment arrangement may comprise the displacement device in the form of at least one crane arm pivotally arranged on a crane base, a deployment winch connected to a wire, a number of pulleys arranged on the crane arm and the crane base, and an actuator which is adapted to move the crane arm. When a side of the deployment structure has been opened, the lifting platform with the inflatable floatable units is starting to be displaced sideways out in a substantially horizontal and linear direction of the deployment structure. The lifting platform is positioned outside the deployment structure by the displacement device having displaced it out of the deployment structure without exceeding the maximum height of the deployment structure, and the platform is ready to be lowered by the displacement device in a substantially vertical direction.

The present deployment arrangement does not occupy much room and it may be fully stored in the deployment structure, meaning that a compact evacuation system is obtained.

Figure 9:
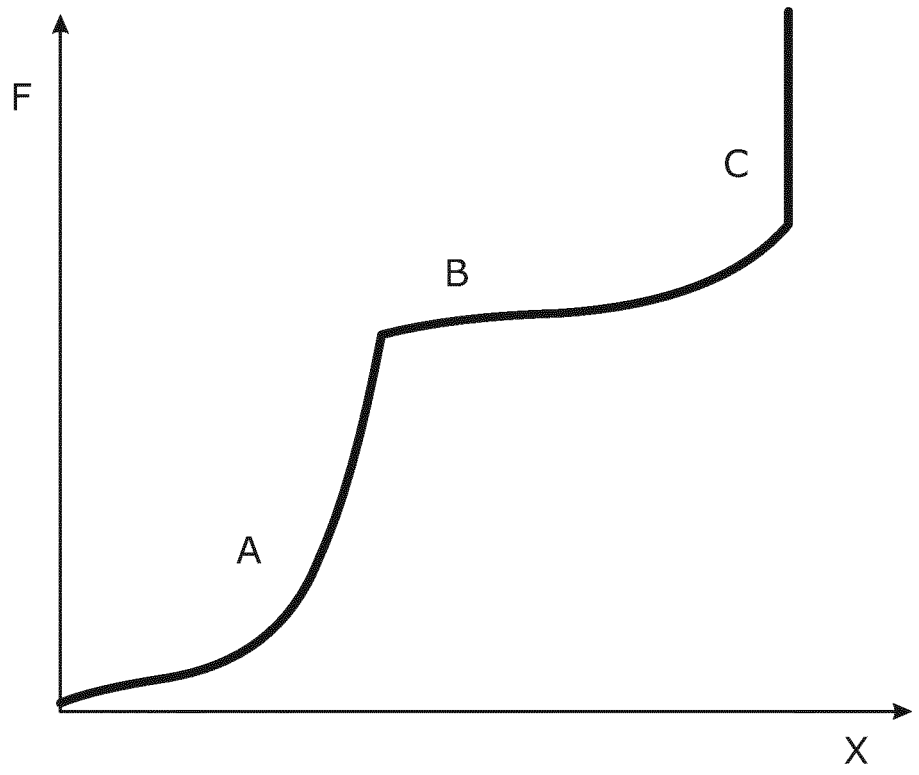
FIG. 9 is a force curve of how the bowsing system according to the invention absorbs forces and loads exerted on the evacuation system.

FIG. 9 shows a force curve for the bowsing system according to the present invention. In area A of the curve, the flexible member absorbs the small constant forces exerted on the bowsing system. In area B of the curve, the hydraulic cylinder/accumulator and the flexible member absorb the major peak loads exerted on the bowsing system. In area C of the curve, both the flexible member and the hydraulic system are at their maximum capacity, thus the inherent elasticity of the bowsing line absorbs the remaining peak loads.

Although the invention has been described in the above in connection with preferred embodiments of the invention, it will be evident for a person skilled in the art that several modifications are conceivable without departing from the invention as defined by the following claims.

The invention claimed is:

1. An evacuation system for positioning and maintaining a position of an inflatable floatable unit in relation to a maritime structure during evacuation of persons at sea, comprising:

a maritime structure from which persons are to be evacuated, an inflatable floatable unit configured to be deployed from the maritime structure, and a bowsing system comprising:

a first bowsing line extending from the maritime structure to the inflatable floatable unit, and a first bowsing winch configured to, by means of the first bowsing line, bowse and position the inflatable floatable unit in relation to the maritime structure after it has been deployed from the maritime structure into the water, wherein the bowsing system further comprises a first hydraulic cylinder having a piston with a first piston end extending outside the first hydraulic cylinder, and a first hydraulic accumulator which is in fluid communication with the first hydraulic cylinder, the first piston end being connected with the first bowsing line between the first bowsing winch and the inflatable floatable unit, wherein the maritime structure comprises at least one side turning point arranged on a side of the maritime structure proximate sea level, the first bowsing line being configured to extend from the maritime structure via the at least one side turning point to the inflatable floatable unit, and wherein, with the first bowsing line guided through the at least one side turning point, the bowsing system is configured to (i) accommodate for differential height of the vessel compared to the maritime structure and (ii) absorb movements of the floatable unit along and/or transverse to the maritime structure.

2. An evacuation system according to claim 1, wherein a first flexible member is connected with the first bowsing line, the first flexible member being arranged between the first bowsing line and the inflatable floatable unit.

3. An evacuation system according to claim 1, wherein the piston has a second piston end within the first hydraulic cylinder having a longitudinal extension, the piston being movable in the longitudinal extension of the hydraulic cylinder.

4. An evacuation system according to claim 1, wherein the first hydraulic accumulator has a first part comprising a gas and a second part comprising a fluid, the second part being fluidly connected with the hydraulic cylinder, and the first part and the second part being separated from each other by a piston or a diaphragm, the hydraulic accumulator having a volume and the hydraulic accumulator being set with a gas pre-charge pressure.

5. An evacuation system according to claim 1, wherein a first valve is arranged between the hydraulic cylinder and the hydraulic accumulator.

6. An evacuation system according to claim 5, wherein the valve is opened by a predetermined position of the first piston end.

7. An evacuation system according to claim 1, wherein the evacuation system comprises a deployment structure connected to the maritime structure.

8. An evacuation system according to claim 7, wherein the bowsing winch, the hydraulic cylinder and the hydraulic accumulator are connected with the deployment structure.

9. An evacuation system according to claim 7, wherein the bowsing system comprises a gearing system, the bowsing line being configured to be led through the gearing system which is arranged between the deployment structure and the first piston end of the hydraulic cylinder.

10. An evacuation system according to claim 9, wherein the gearing system comprises a plurality of structure turning points connected with the deployment structure and at least a piston turning point connected with the first piston end.

11. An evacuation system according to claim 7, wherein the deployment structure comprises horizontal beams and vertical beams.

12. An evacuation system according to claim 1, wherein the hydraulic cylinder is arranged vertically or horizontally.

13. An evacuation system according to claim 12, further comprising structure turning points primarily arranged (i)on a horizontal beam arranged above the hydraulic cylinder when the hydraulic cylinder is arranged vertically, or (ii) on a vertical beam when the hydraulic cylinder is arranged horizontally.

14. An evacuation system according to claim 1, wherein the bowsing system comprises:

a second bowsing line extending from the maritime structure to the inflatable floatable unit, a second bowsing winch configured to bowse and position the inflatable floatable unit in relation to the maritime structure after it has been deployed from the maritime structure into the water, a second hydraulic cylinder having a piston with a first piston end extending outside the second hydraulic cylinder, and a second hydraulic accumulator being in fluid communication with the second hydraulic cylinder, the first piston end being connected with the second bowsing line between the second bowsing winch and the inflatable floatable unit.

15. A bowsing method for positioning and maintaining a position of an inflatable floatable unit in relation to a maritime structure during evacuation of persons at sea, comprising:

providing an evacuation system according to claim 1, deploying an inflatable floatable unit from the maritime structure, bowsing the inflatable floatable unit by means of the bowsing winch and bowsing line in relation to the maritime structure, and absorbing forces exerted on the inflatable floatable unit by means of the hydraulic cylinder.

* * * * *